US006736695B1

(12) United States Patent
Hoch

(10) Patent No.: US 6,736,695 B1
(45) Date of Patent: May 18, 2004

(54) SPORTS FAN'S NOISE MAKER

(76) Inventor: Stuart Hoch, 7 Hudson Ter., Marlboro, NJ (US) 07746

( * ) Notice: Subject to any disclaimer, the term of this patent is extended or adjusted under 35 U.S.C. 154(b) by 0 days.

(21) Appl. No.: 10/437,705

(22) Filed: May 14, 2003

(51) Int. Cl.[7] ..... A63H 5/00
(52) U.S. Cl. ..... 446/397; 446/421
(58) Field of Search ..... 446/202–204, 446/207, 209, 397, 213, 192, 81, 73, 236, 418, 421; 473/567

(56) References Cited

U.S. PATENT DOCUMENTS 797,572 A * 8/1905 Goldberg
1,113,162 A * 10/1914 Murphy
3,177,614 A * 4/1965 Price
4,898,384 A * 2/1990 Beach ..... 273/26 R
5,133,551 A * 7/1992 Handy ..... 273/72 R
D368,114 S * 3/1996 Hyvonen ..... D19/42
5,590,875 A * 1/1997 Young ..... 473/457
D418,869 S * 1/2000 Nussinow et al. ..... D19/42
2001/0034177 A1 * 10/2001 Hunn ..... 446/73

* cited by examiner

*Primary Examiner*—Stuart Hoch
*Assistant Examiner*—Jamila O Williams
(74) *Attorney, Agent, or Firm*—Daniel Kirshner

(57) ABSTRACT

Sports fan's noise maker. The noise maker includes a noise making mechanism, said noise making mechanism comprising a disk-shaped outer casing. Contained within the outer casing is a gear with an attached handle, said handle extending outward through an aperature on the bottom of the casing. A striker is attached to the bottom wall of the casing and extends upward and is configured to abut against the gear when the device is rotated. A miniature baseball bat has a handle-receiving aperture at one end (the barrel end). The handle of the noise maker is firmly fitted into the aperture. In addition, a miniature baseball helmet is provided wherein the noise making mechanism is fitted into the bottom of the helmet. If desired a writing implement may be provided that is inserted into the end of the baseball bat opposite to the noise maker. Furthermore, if desired, a pennant showing the team colors and/or logo may be attached to the batting helmet.

7 Claims, 10 Drawing Sheets

SPORTS FAN'S NOISE MAKER

FIELD OF THE INVENTION

The present invention is a noise maker for use at sporting events or other mass gatherings. More specifically, the present invention comprises noise making mechanism that is enclosed in a miniature baseball batting helmet and further includes an attached miniature baseball bat.

BACKGROUND OF THE INVENTION

It is a popular pastime around the world to attend sporting events, and it is frequently the practice to root for one's favorite team or player and to make as much noise as possible. One method of creating noise is by clapping and yelling. Alternatively, to reduce the stress on the vocal cords of the fans, and to increase the volume of the clamor, it has become common practice to utilize mechanical noise makers to create the crowd noise.

Moreover, fans like to carry with them objects, be they full sized or miniature, that mimic the equipment used by the players or contain the name of the team, or the logo of the team or player for whom they are rooting. For example, it is common when attending baseball games for members of the crowd to bring along full sized or miniature articles that are employed in the game of baseball. Specifically, miniature baseball bats, and full size or miniature batting helmets are frequently carried or worn. Moreover, these articles may display the name and/or the logo or insignia of the team or the fan's favorite player.

It would be an advantage to provide a device that can serve as a noise maker and also serve to the purpose of giving the baseball fan an object to carry into the sporting event that displays the fan's allegiance to a particular team or player. It would further be advantageous if the object were an implement that is representative of the equipment that is used in the sport, be it full size or in miniature. Finally, it is further advantageous if the noise maker also serves as a writing instrument.

SUMMARY OF THE INVENTION

The present invention is a sports fan's noise maker. The noise maker includes a noise making mechanism, said noise making mechanism comprising a disk-shaped outer casing. Contained within the outer casing is a gear with an attached handle, said handle extending outward through an aperture on the bottom of the casing. A striker is attached to the bottom wall of the casing and extends upward and is configured to abut against the gear when the device is rotated.

A miniature baseball bat has a handle-receiving aperture at one end (the barrel end). The handle of the noise maker is firmly fitted into the aperture. In addition, a miniature baseball helmet is provided wherein the noise making mechanism is fitted into the bottom of the helmet. If desired a writing implement may be provided that is inserted into the end of the baseball bat opposite to the noise maker. Furthermore, if desired, a pennant showing the team colors and/or logo may be attached to the batting helmet.

The user can utilize the device by grasping onto the baseball bat. When desired, the user rotates the miniature baseball bat there transmitting rotation to the noise making mechanism.

DESCRIPTION OF THE DRAWINGS

For a better understanding of the invention, reference is made herein to the following description of an exemplary embodiment thereof, considered in conjunction with the accompanying drawings, in which.

DETAILED DESCRIPTION OF THE INVENTION

Figure 1:
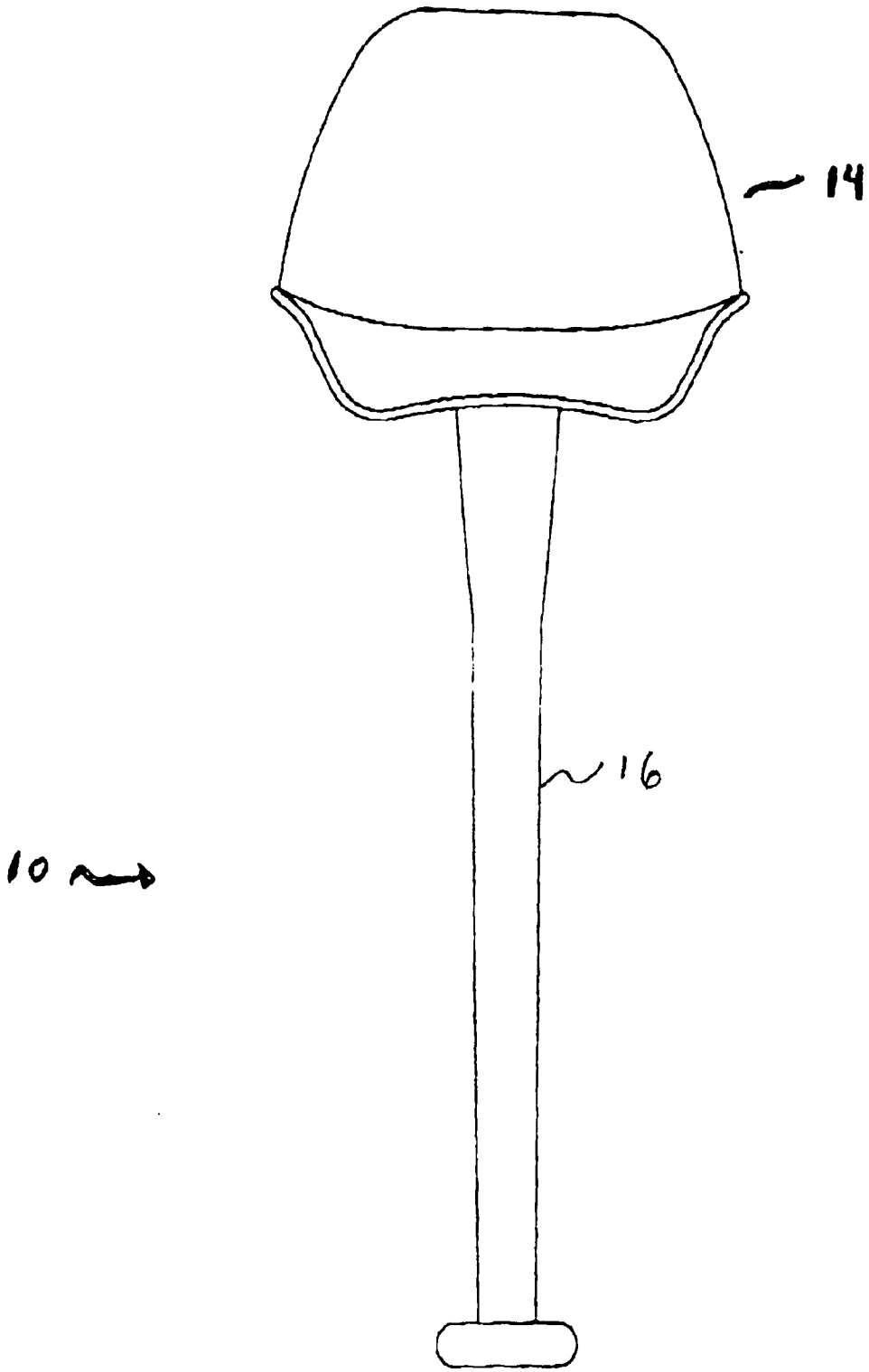
FIG. 1 is a front plan view of the present invention noise maker.
Figure 2:
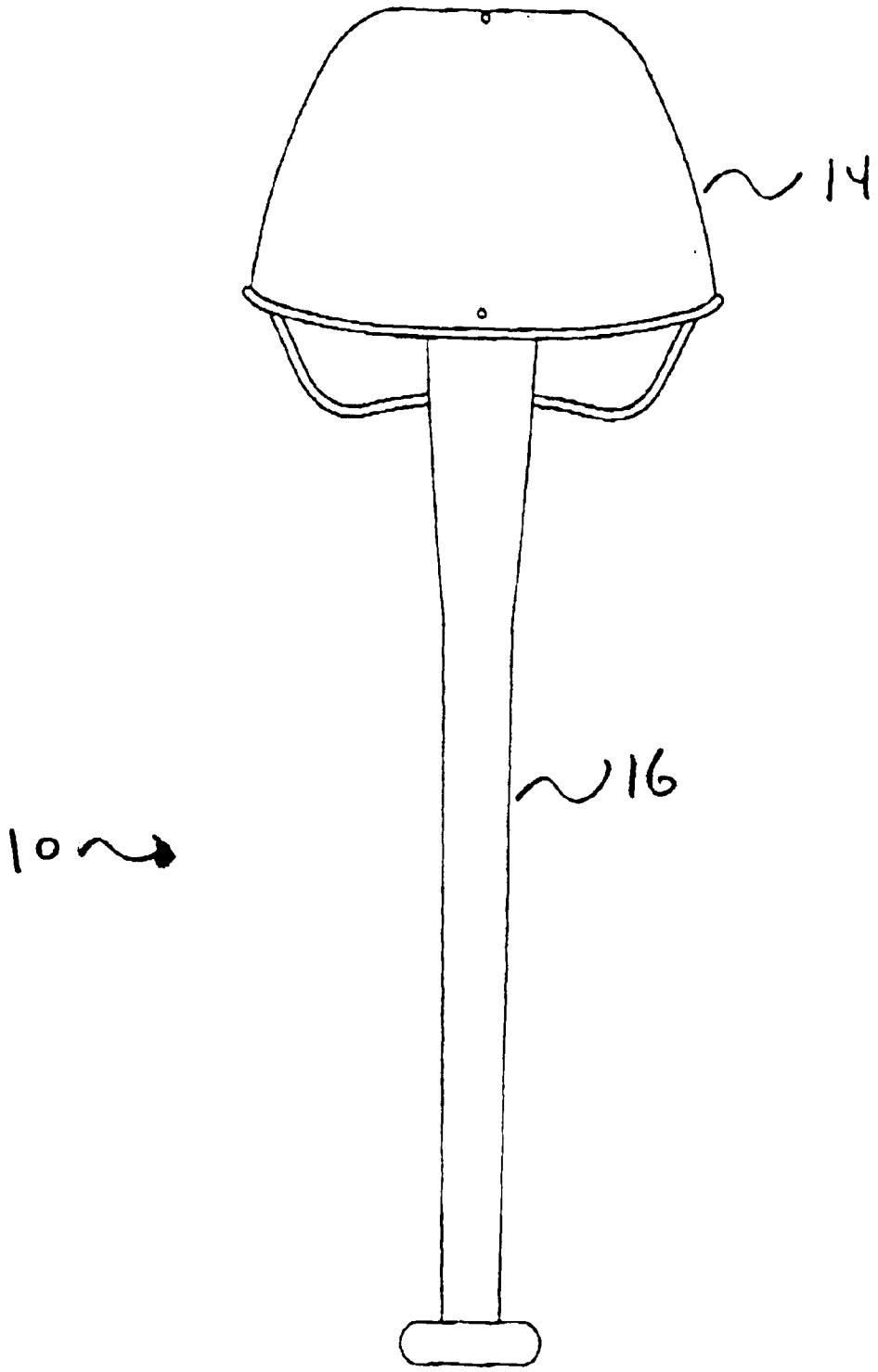
FIG. 2 is a rear plan view of the present invention noise maker.
Figure 3:
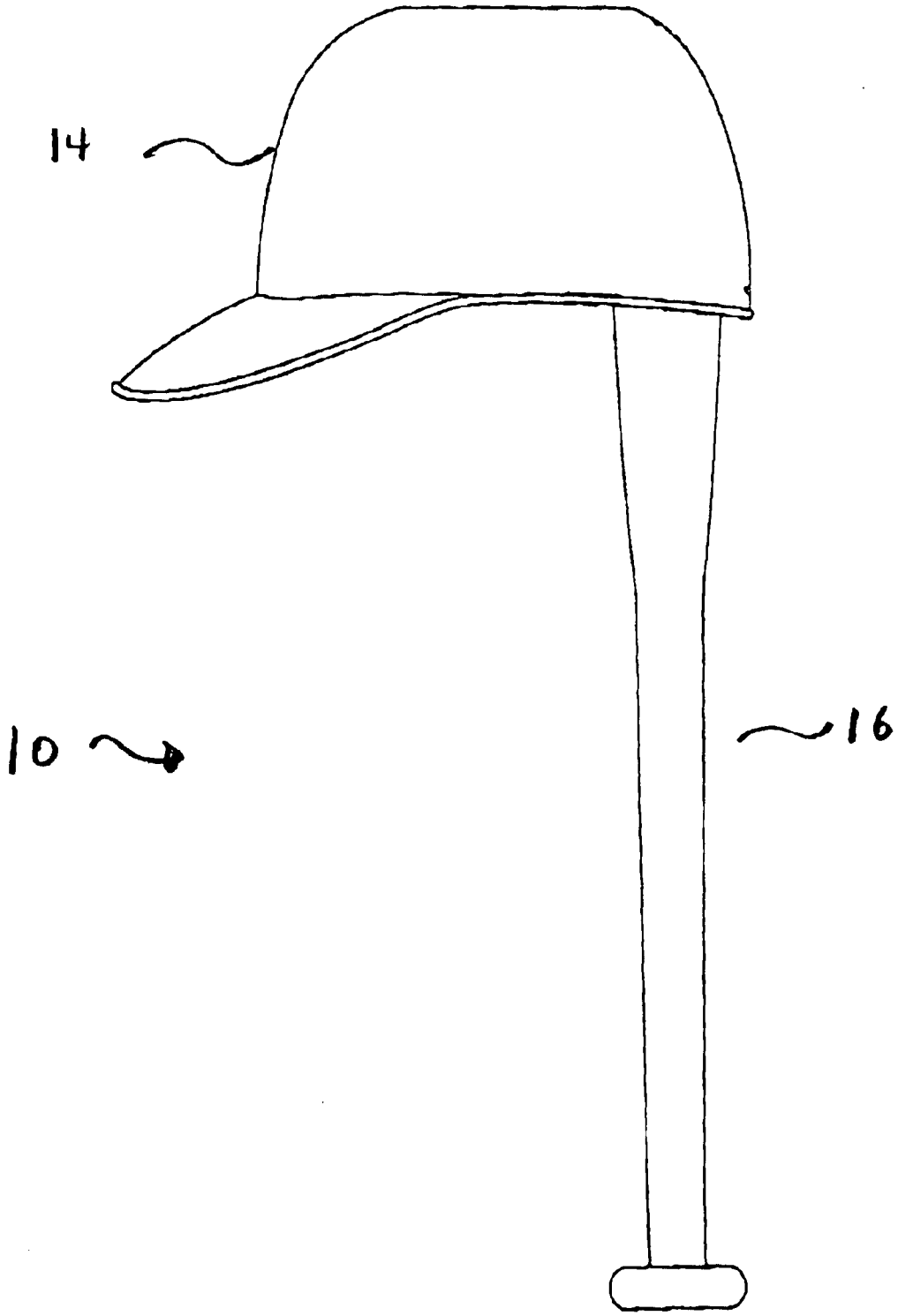
FIG. 3 is a right side plan view of the present invention noise maker.
Figure 4:
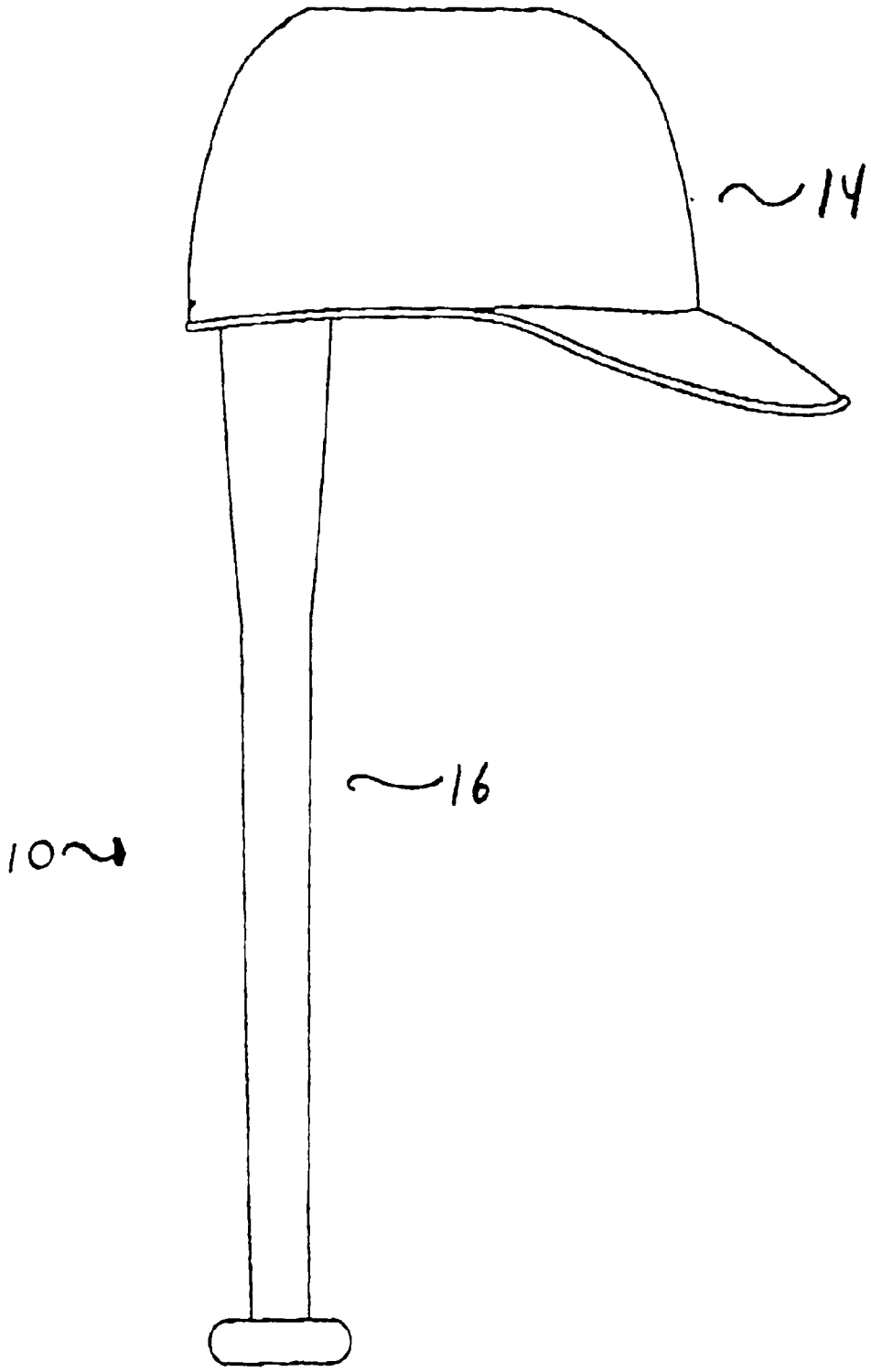
FIG. 4 is a left side plan view of the present invention noise maker.
Figure 5:
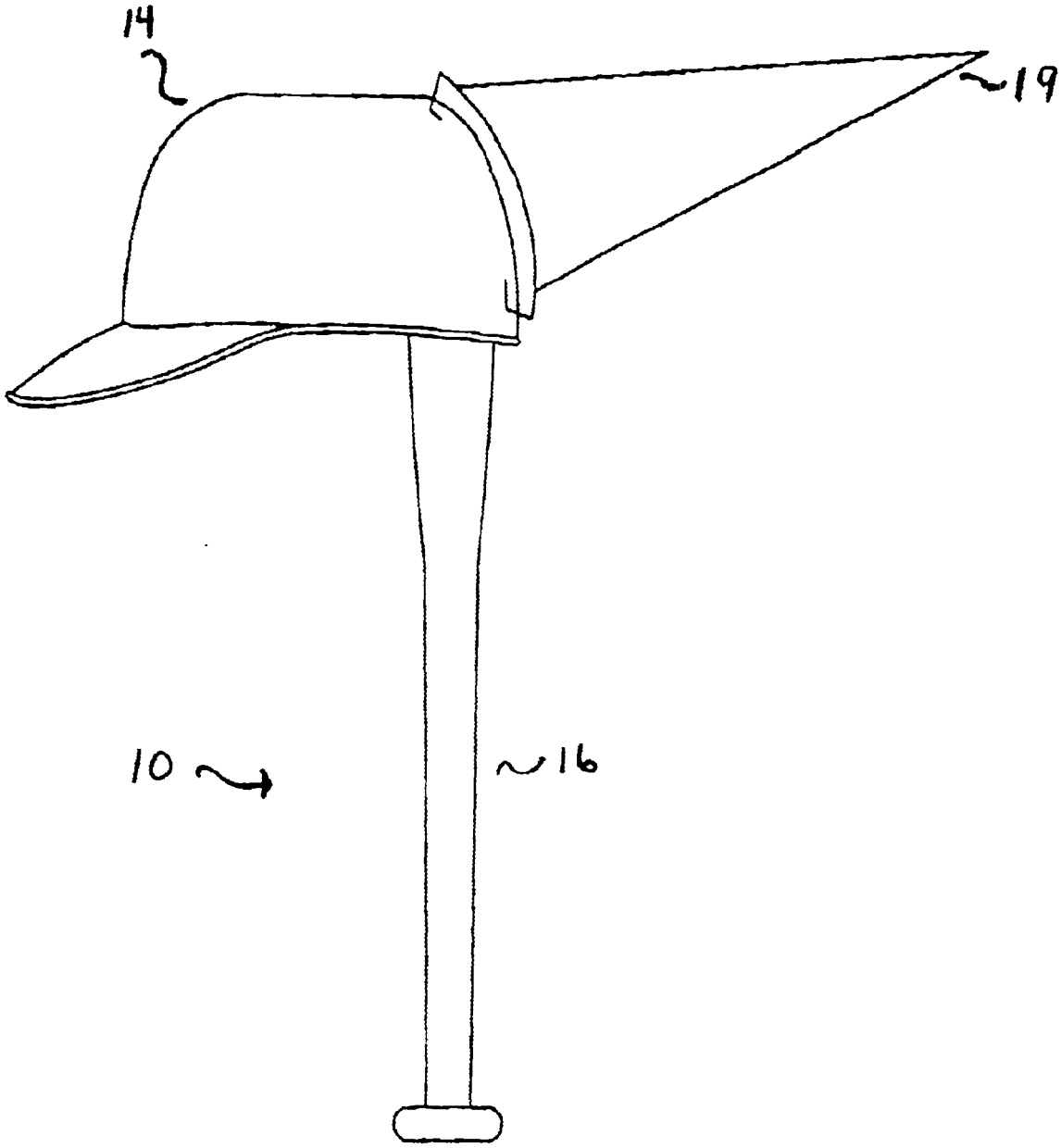
FIG. 5 is a right side plan view of the present invention noise maker showing an embodiment that includes an attached pennant.

Referring to the figures, the present invention is a noise making device 10 suitable for use at sporting events, or other such mass gatherings. Generally, the noise making device comprises a noise making mechanism 12, a miniature baseball batting helmet 14, and a miniature baseball bat 16. In one embodiment the noise making device further includes a pennant 18 attached to the batting helmet. In an alternate embodiment, the noise making device further comprises a writing implement (not shown in the figures) that is enclosed within the baseball bat.

Figure 6:
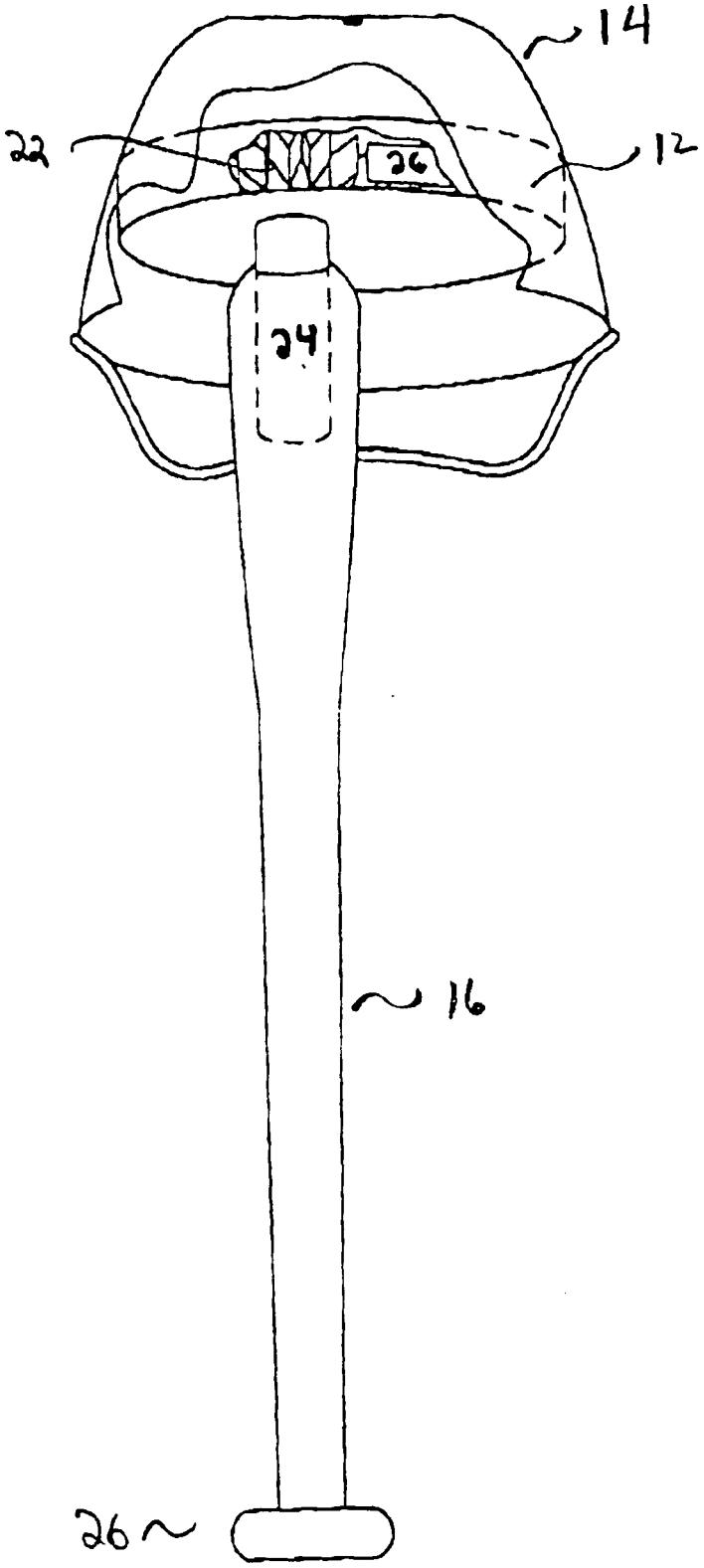
FIG. 6 is a rear plan view of the present invention noise maker with a partial cutaway showing the noise making mechanism.
Figure 7:
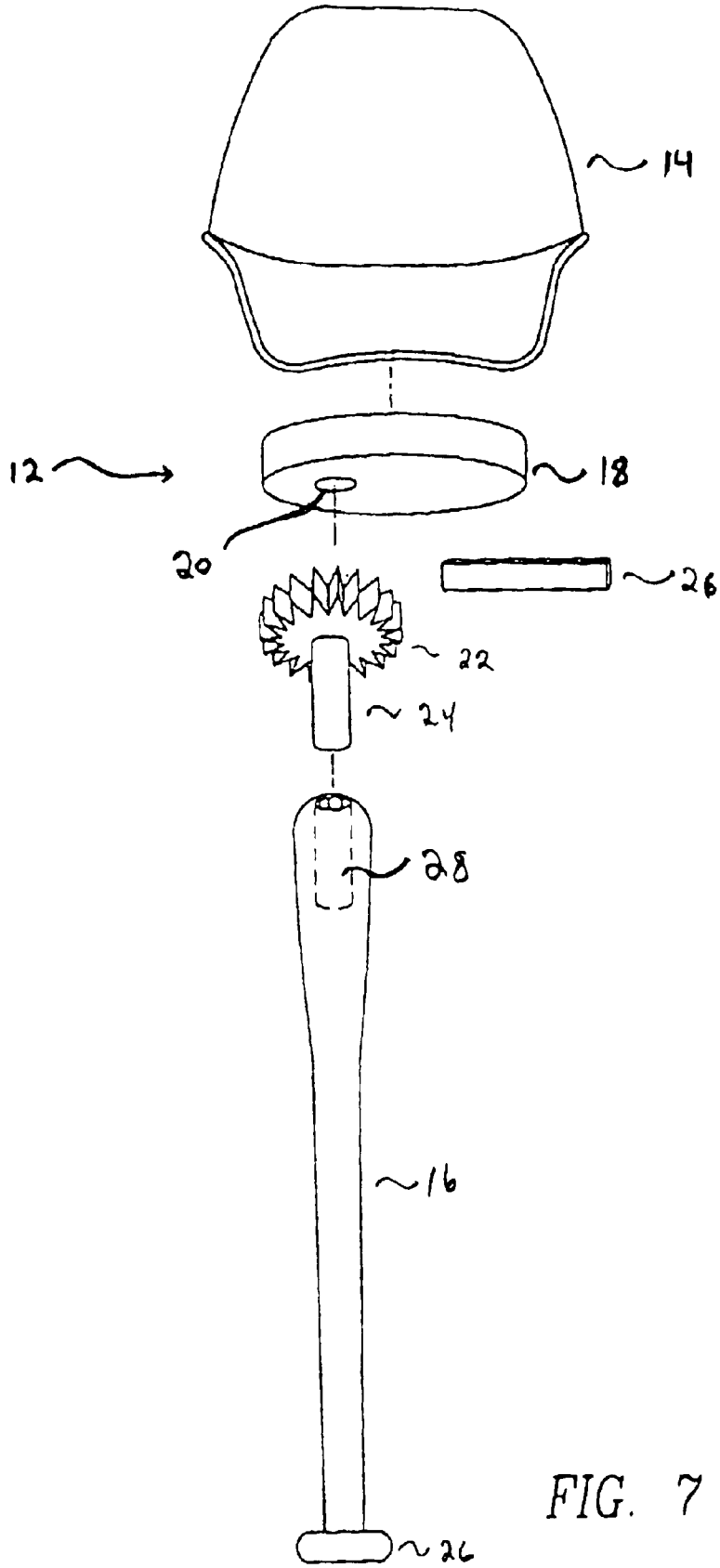
FIG. 7 is an exploded view of the present invention noise maker showing the noise making mechanism.
Figure 8:
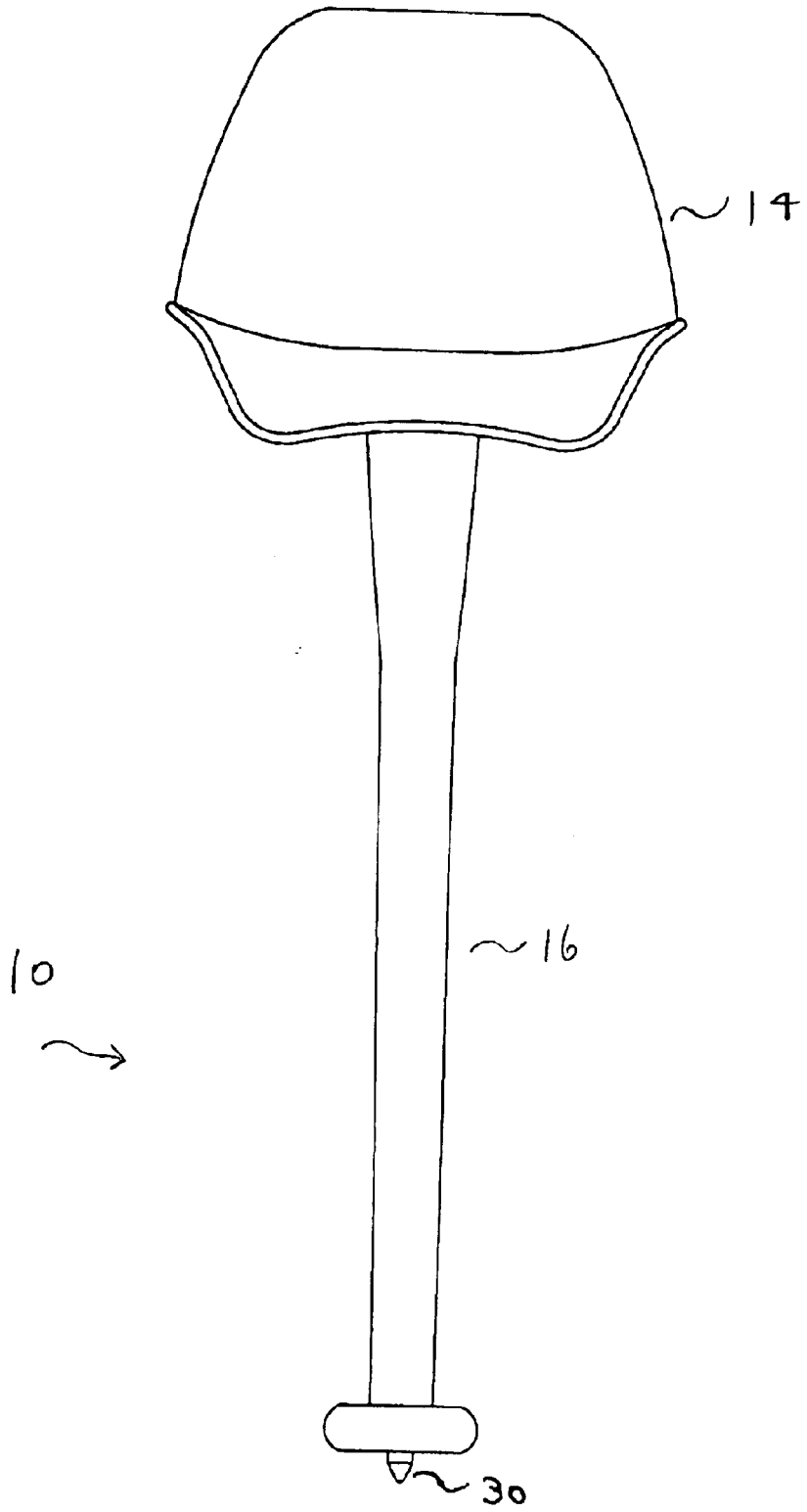
FIG. 8 is a front plan view of the present invention noise maker showing the writing implement.
Figure 9:
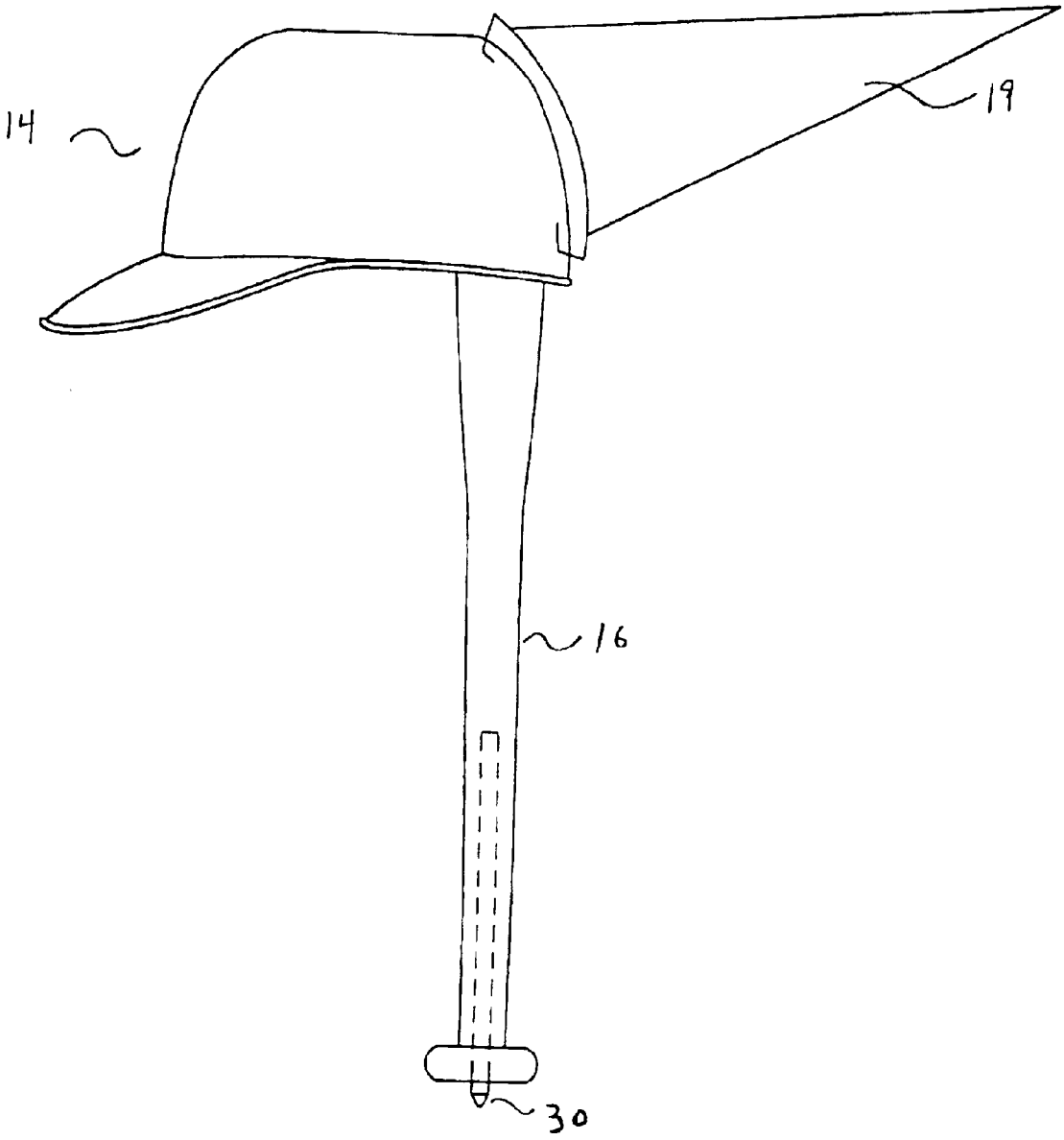
FIG. 9 is a front plan view of the present invention noise maker showing both the pennant and the writing implement.
Figure 10:
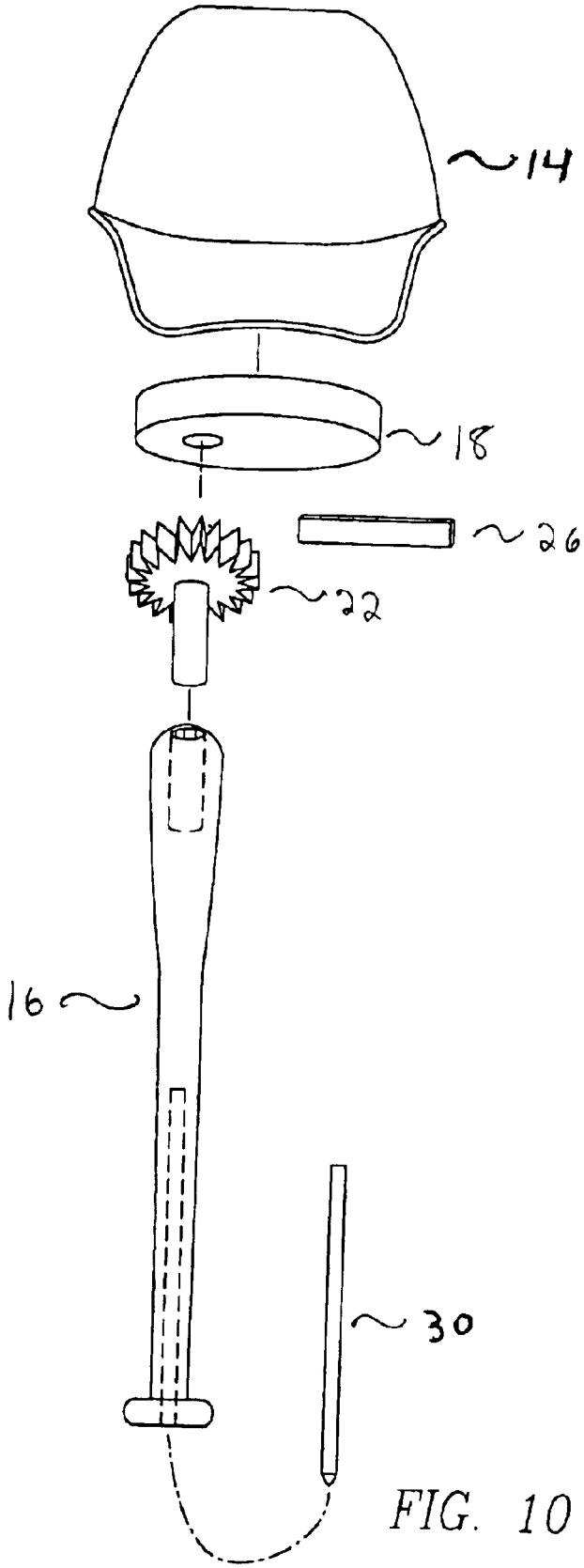
FIG. 10 is a exploded front plan view of the present invention noise maker showing the writing implement.

Referring now to FIGS. 6 and 7, where FIG. 6 is a partially cutaway view and FIG. 7 is an exploded view, the noise making mechanism 12 is seen in greater detail. The noise making mechanism 12 shown here is a standard off-the-shelf prior art noise making mechanism. It includes a disc-shaped outer casing 18. (Although the casing here is shown as being circular, it need not be. Off-the-shelf noise making mechanisms in other configurations are suitable.) As shown here, the casing is formed from metal, but it could be plastic or other suitable material. The casing 18 includes an off-center aperture 20 on its bottom.

A gear 22 having gear teeth is provided and is located within the casing 18. The size of the gear is not critical so long as it is smaller than the casing thereby allowing free rotation. An elongated handle 24 is firmly attached to the center of the bottom of the gear. The diameter of the handle should be small enough to allow it to fit through the aperture 20. It will be appreciated that in accordance with prior art noise making devices, the gear is positioned within the casing such that the handle protrudes through the aperture. A striker 26 formed from an elongated piece of material is provided. The striker is formed as a flat attachment extending upward from the bottom panel of the casing and should be flexible enough to permit displacement which it makes contact with the gear teeth.

It will be appreciated that the noise maker operates in the following manner. Generally, a sports fan or other user grasps the handle 24 and spins the noise making mechanism (i.e. the casing spins along with the striker whereas the gear remains stationary.) As such, the striker makes contact with the gear teeth. As the striker is flexible, it is caused to deflect and retract thereby creating the desired sound. As is known in the art, the casing of the noise making mechanism will be caused to accelerate, i.e. rotate faster than the baseball bat, as a proximate result of the offset location of the handle aperture on the case thereby amplifying the resultant noise.

A miniature batting helmet 14 is provided and the noise making mechanism is affixed inside of the batting helmet 14. Miniature batting helmets are usually formed from plastic and often have the insignia of a particular sports team displayed thereon. It is understood that being helmet, it has an interior portion. Although the invention is shown utilizing a miniature batting helmet, the invention also encompasses using a full-size batting helmet, or any other cap having an interior.

The noise making mechanism is attached inside the interior of the miniature baseball helmet as is shown in FIG. 6. Although not necessary, ideally the external circumference of the outer casing 18 is chosen so that it fits snugly inside the underside of the batting helmet. Of course, so long as the outer casing is smaller than the interior of the underside of the batting helmet, it can be configured (e.g. through employment of spacing bars) to mate with the batting helmet.

The present invention further includes a miniature baseball bat 16 which may be formed from wood, metal, plastic or other rigid material. The baseball bat 16 tapers to a narrower end that includes a knob 26 at the bottom. The end opposite to the knob end is wider (the barrel end) and a handle-receiving aperture 28 is drilled therein. (This is illustrative the aperture could easily be introduced into either end of the bat.) The handle from the noise making mechanism 24 is introduced into the handle-receiving aperture 28. Obviously, the handle must fit snugly into the aperture and may be glued or otherwise affixed to insure proper attachment.

Now, it will be seen that a fan may grasp hold of the knob end of the miniature baseball bat 16. When the user spins the bat, the casing of the noise making device will be caused to rotate, thereby causing the striker to the contact the gear. As such, the noise will be emitted. It is further understood that the miniature batting helmet will be caused to rotate in coordination with the noise making mechanism as they are attached to each other.

The present invention may also include a pennant 19 affixed to the batting helmet. The pennant, as indicated herein, may include a team name, logo or other indicia of a favorite team.

Finally, the present invention may also include a writing implement 30. The writing implement will be inserted into a hollowed out section of the bottom end (knob end) of the baseball bat. The writing implement may be a ball-point pen, pencil, felt marker, or other such device.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A noise making device, comprising:

a miniature batting helmet;

a noise making mechanism affixed inside said miniature batting helmet, said noise making mechanism including a case, a gear having a handle attached to said gear enclosed within said case, and a striker; and a miniature baseball bat attached to said handle of said noise making mechanism, whereby a user grasps and spins said baseball bat, thereby causing said striker to interact with said gear thereby generating noise.

2. The noise making device of claim 1 which further comprises a writing implement contained within said baseball bat.

3. The noise making device of claim 1 which further comprises a pennant attached to said batting helmet.

4. A noise making device comprising:

a miniature baseball cap;

a noise making device attached the inside of said cap; and a baseball bat attached to said noise making device, whereby a user manipulates said baseball bat causing said noise making device to emit sound.

5. The noise making device of claim 4 which further includes a writing implement contained within said baseball bat.

6. The noise making device of claim 4 which further includes a pennant attached to said cap.

7. A noise making device comprising:

a cap;

a noise making device attached to said cap;

a baseball bat attached to said noise making device; and a pennant attached to said cap whereby a user manipulates aid baseball bat causing said noise making device to emit sound.

* * * * *